United States Patent [19]

Ross

[11] 4,158,104

[45] Jun. 12, 1979

[54] CURVED WOVEN CABLE AND METHOD

[75] Inventor: Edgar A. Ross, Greenville, S.C.

[73] Assignee: Southern Weaving Company, Greenville, S.C.

[21] Appl. No.: 803,403

[22] Filed: Jun. 3, 1977

[51] Int. Cl.[2] ..... H01B 7/08

[52] U.S. Cl. ..... 174/117 M; 29/624; 156/55; 174/117 F

[58] Field of Search ..... 174/117 M, 117 F, 72 TR; 139/386; 156/47, 55; 29/624

[56] References Cited

U.S. PATENT DOCUMENTS

| | | | |
|---|---|---|---|
| 1,750,533 | 3/1930 | Ludorf | 139/386 |
| 1,941,121 | 12/1933 | Van Der Straeten | 174/72 TR |
| 2,113,261 | 4/1938 | Walters | 139/386 |
| 3,495,025 | 2/1970 | Ross | 174/117 M |

FOREIGN PATENT DOCUMENTS

| | | | |
|---|---|---|---|
| 494083 | 7/1926 | Fed. Rep. of Germany | 139/386 |
| 265521 | 7/1929 | Italy | 139/386 |

OTHER PUBLICATIONS

"Multi-tet" brochure.

*Primary Examiner*—E. A. Goldberg
*Attorney, Agent, or Firm*—Bailey, Dority & Flint

[57] ABSTRACT

A curved woven cable having a plurality of conductors and a method for constructing the same is disclosed wherein warp binder strands and a fill strand are interwoven with the conductors with at least one void area being formed in which the conductors are not interwoven with the warp strands and fill strands so that the cable may be curved. In a preferred method, the void area is formed by weaving the warp strands and fill strands with the conductors removed from the weave to form a weave portion floated outside of the conductors but which remains an important structural portion of the cable in maintaining its curved configuration.

15 Claims, 5 Drawing Figures

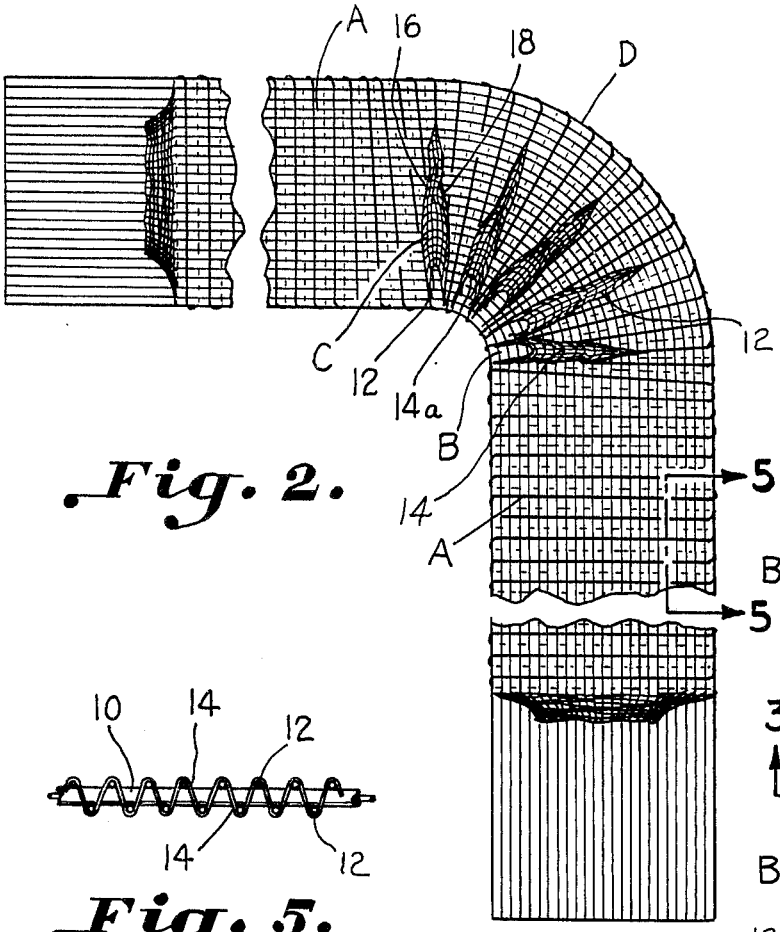
Fig. 2.
Fig. 5.
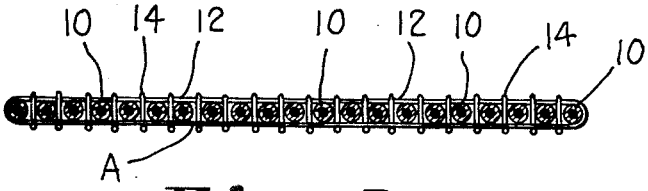
Fig. 3.
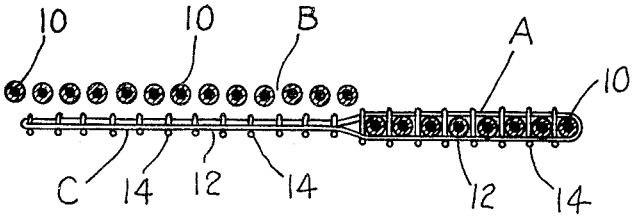
Fig. 4.
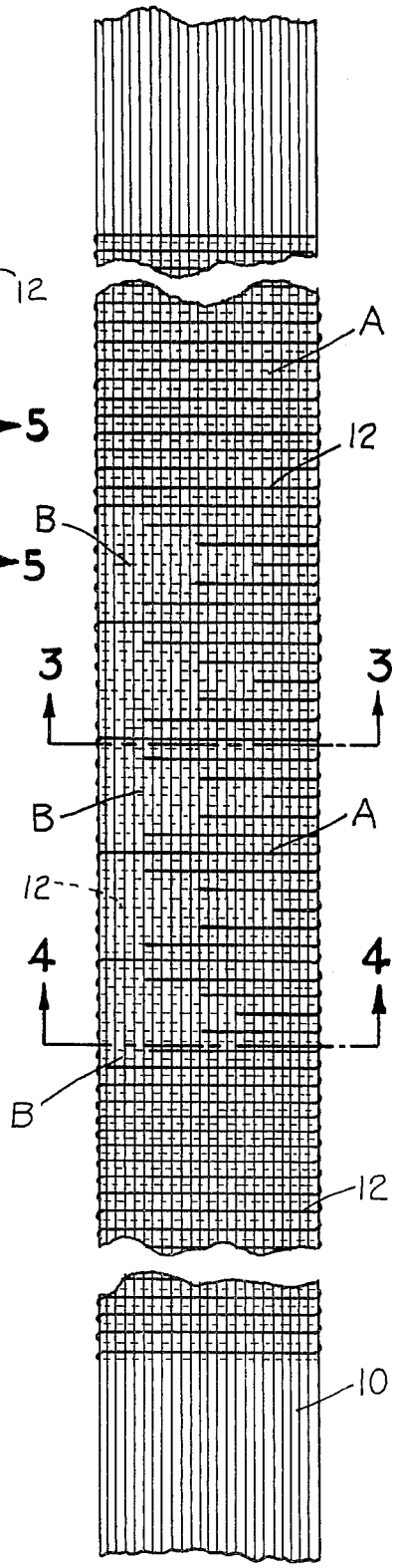
Fig. 1.

CURVED WOVEN CABLE AND METHOD

BACKGROUND OF THE INVENTION

In many electrical wiring applications, such as in communications and aircraft systems, it is necessary to route the wiring in different directions. Woven flat cable of the type having a plurality of conductors arranged in a side-by-side manner is particularly difficult to curve and maintain curved especially without bulking and strain.

It has been heretofore proposed to manufacture a wiring harness in a curved configuration such as in U.S. Pat. No. 3,911,201 wherein a plurality of conductors are curved and sandwiched between a pair of thermoplastic sheeting strips. However, it has not been practical up to this point to provide a curve in flat woven cable of the type wherein the individual conductors are arranged side-by-side and bound together by the interweaving of the warp and fill strands.

SUMMARY OF THE INVENTION

It has been found that a construction and method for a curved woven cable having a plurality of conductors arranged generally side-by-side can be had by providing a woven cable portion wherein a plurality of warp strands and a continuous fill strand are mutually interwoven with the conductors to bind the conductors together. A curved cable portion includes at least one void area wherein the conductors are not interwoven with the warp strands and the fill strand leaving the conductors relatively unbound in the void area. The void area is preferably formed by floating the weave of warp and fill strands outside of the conductors and cable in this area. The method contemplates curving the cable about the void area to assume a desired curved configuration and applying a conforming coating to maintain the form of the curved portion.

Accordingly, an important object of the present invention is to provide a curved cable of the generally flat woven type and a method for constructing the same.

Another important object of the present invention is to provide a curved woven cable which may be curved to any desired configuration and fixed in its configuration.

Another important object of the present invention is to provide a method for forming a curved cable of the flat woven type wherein any number of void areas are formed leaving the conductors unwoven and relatively unbound whereby the cable may be curved around the void areas to achieve any desired curved configuration.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a top plan view of a flat woven cable constructed in accordance with the present invention prior to being curved illustrating a woven portion wherein the conductors are bound and void areas wherein the conductors are relatively unbound, FIG. 2 is a bottom plan view of a woven curved cable constructed in accordance with the present invention, FIG. 3 is a schematic illustration of a view taken along line 3—3 of FIG. 1, FIG. 4 is a schematic illustration of a view taken along line 4—4 of FIG. 1, and FIG. 5 is an enlarged view of a section taken along line 5—5 of FIG. 2.

DESCRIPTION OF A PREFERRED EMBODIMENT

The invention relates to curved woven cables of the generally flat type having a plurality of conductors arranged in a side-by-side relationship and to the method of making same. Woven cable is a form of ribbon construction wherein generally parallel placement of conductors is achieved by textile techniques of weaving warp strands and a continuous fill strand about the insulated conductors. The invention is particularly applicable to cables which are woven with a plain weave pattern on a conventional weaving loom wherein the individual conductor wires and warp strands are held by individual heddles which are cam operated to form openings between which the shuttle carrying the fill strand passes to interweave with the warp strands. The programming of the heddles to form the desired weave and apparatus for weaving such is conventional and accordingly will not be described herein. Having been taught the method and construction of a curved woven cable in accordance with the present invention, one skilled in the weaving of electrical cables will be readily able to make curved cables in accordance with the present invention.

The drawings illustrate a woven cable having a woven portion A in which a plurality of warp binder strands and a single fill strand are mutually interwoven with the conductors to bind the conductors together. The cable also includes at least one void area B in which the conductors are not interwoven with the warp strands and the fill strand leaving the conductors relatively unbound in the void area. The warp strands and fill strand are interwoven outside of the conductors in the void area to form a floated weave portion C which is floated and woven outside of the conductors. It will be noted that the void areas B are bounded by the woven cable portion A around the entire perimeter thereof.

Referring now in more detail to the drawing, it will be seen that the cable has a generally flat configuration by the placing of the individual conductors 10 in a side-by-side manner. A continuous fill strand 12 is woven across the entire width of the cable and the conductors 10 with a plurality of warp binder strands 14 which run from top to bottom longitudinally between adjacent conductors as best illustrated in FIG. 3. This weave pattern wherein the conductors 10, the warp binder strands 14 and the fill strand 12 are mutually interwoven forms the portion of the cable referred to as woven cable portion A. Ordinarily, in a straight section of flat woven cable, such a weave pattern is formed uniformly along the entire length of the cable except at the ends thereof whereat the conductors are broken out of the weave pattern for terminal connection. For the sake of clarity and illustration, the warp strands 14 have not been shown in the woven portion A in FIGS. 1 and 2 although such could be thought of as represented by the dark lines which delineate the conductors 10.

As illustrated in FIG. 2, a curved cable is provided in accordance with the present invention having a curved portion D. The curved cable will now be described in more detail by first referring to FIG. 1 wherein the cable is first woven straight having void areas B. In the preferred embodiment, the void areas B are formed by lifting or dropping the conductors 10 out of the weaving pattern. This may be accomplished by programming the heddles whereby the conductors are pulled either upwardly or downwardly out of the weave pattern. As illustrated, the conductors are pulled upwardly out of the weaving pattern to form the void area B such as best seen in FIG. 4. The fill strand 12 and the warp strands 14 are then interwoven without the conductors 10 to form the weave portion C which is floated outside of the conductors below the cable.

By reference to FIG. 2, the floated weave portion C will be described in more detail. The outermost warp strand 14*a* is secured to the cable at the edge by the fill strand 12 which is last a part of the woven cable portion A on either side of the void space B. The intermediate binder strands 14 are likewise woven with the fill strand 12 as it is broken out at different points across the width of the cable in the curved portion D while the warps 14 are viewed as broken or floated out at different points along the length of the curved portion. The floated weave portion C is then but a web of material formed from the interweaving of the binder strands and fill strands which are woven excluding the conductors in the area of the void. The void area and floated weave are bounded by the woven cable portion A adjacent the perimeter thereof. The boundary of the void area B may be expressed as the lines 16 and 18 which are defined by the points at which the warp strands 14 and the fill strand 12 are broken out along the width and length of the cable in the curved portion to form the floated weave C. The lines 16 an 18 can be seen as a trace line of the points at which the fill strand is broken out from the conductors and interwoven solely with the warp strands which is accomplished by removing or lifting out the conductors from the weave pattern in the void area.

FIG. 2 illustrates the cable in its final curved form which is arrived at by bending or curving the cable about the void areas B to form the curved portion D. The conductors are relatively unbound in the void area which permits the woven strands to slide relative to the conductors as the cable is bent or curved, either manually or by machine, to assume a desired curved configuration. To maintain the cable in its curved configuration, the method contemplates the step of applying a conforming coating to the curved portion of the cable which in essence, hardens and sets the floated weave portions C and the woven portion A in the curved portion D. Any suitable coating may be utilized which will maintain the form of the curved configuration such as polyurethane or silicone rubber. The coated weave portions C thus become an important structural element in holding the cable in a generally rigid configuration. While many types and sizes of conductor wires may be utilized, it has been found that conductor wires with Teflon or Tefzel insulation coatings are an expedient to permitting the weaving strands to slide easily thereover when the cable is being curved.

It is noted in FIG. 4 that the woven cable portion A and the void area B are contiguous with the fill strand 12 continuously woven through the woven cable portion A and the floated weave portion C. Futhermore, the void area B is bounded on its sides by the woven cable portion A which, it is noted, is formed between adjacent void areas B.

Thus it can be seen that an advantageous method and construction for a curved woven cable can be had in accordance with the present invention whereby a desired curved configuration for a generally flat cable can be had and maintained without bulk and strain on the conductors. The cable is simple in construction and the method may be carried out on any conventional weaving loom whereby the number and size of the void areas B may be varied. Varying the number and size of the void areas allows the woven strands to slide on the conductors in a varying amount to permit the desired degree of curvature.

While a preferred embodiment of the invention has been described using specific terms, such description is for illustrative purposes only, and it is to be understood that changes and variations may be made without departing from the spirit or scope of the following claims.

What is claimed is:

1. A curved woven electrical cable having a generally flat configuration comprising:
   - a plurality of conductors;
   - a woven cable portion including a plurality of warp binder strands and a fill strand interwoven with said conductors to bind said conductors together; and
   - a curved cable portion including at least one void area wherein said conductors are present but are not interwoven with said warp strands and said fill strand leaving said conductors relatively unbound in said void areas.

2. The cable as set forth in claim 1 wherein said warp strands and said fill strand are interwoven in said void areas excluding said conductors to define a weave portion floated outside of said conductors.

3. The cable as set forth in claim 1 including a plurality of said void areas spaced along the length of cable in said curved portion.

4. The cable as set forth in claim 2 wherein said curved cable portion includes said woven cable portion wherein said conductors are bound contiguous with said unbound conductors of said void areas.

5. The cable as set forth in claim 1 wherein said void areas are spaced inwardly radially from said woven cable portion.

6. The cable as set forth in claim 5 wherein said woven cable portion is formed between adjacent void areas.

7. The cable as set forth in claim 2 wherein said fill strand is continuously woven through said floated weave portion and said woven cable portion which is contiguous with said floated weave portion in said curved cable portion.

8. The cable as set forth in claim 1 wherein said fill strand is broken out from said woven cable portion at different points across the width and length of said curved portion to form said void area.

9. The cable as set forth in claim 1 wherein said void area is bounded by said woven cable portion.

10. A method for forming a curved portion in a woven electrical cable of the type formed from a plurality of conductors arranged in a side-by-side generally flat configuration and a plurality of warp binder strands and a fill strand interwoven with said conductors to define a woven cable portion in which said conductors are bound comprising the steps of:

providing at least one void area in said cable in which said conductors are present but are not interwoven with said warp strands and said fill strand so that said conductors are relatively unbound in said void area;

bending said cable about said void area so as to assume a desired curved configuration.

11. The method as set forth in claim 10 wherein said void area is provided by interweaving said warp strands and said fill strand outside of said conductors to form a weave portion floated outside said woven cable portion.

12. The method as set forth in claim 10 comprising the step of applying a conforming coating to said curved portion of said cable for maintaining said curved configuration.

13. The method as set forth in claim 10 wherein said void area if formed by breaking out said fill strand from said conductors at different points across the width and length of said cable.

14. The method as set forth in claim 10 comprising forming a plurality of said void areas as required for bending said cable into said curved configuration.

15. The method as set forth in claim 11 wherein said fill strand is woven continuously across said woven cable portion and said floated weave portion.

* * * * *